United States Patent [19]

Paulson

[11] Patent Number: 5,072,922

[45] Date of Patent: Dec. 17, 1991

[54] VACUUM DRUM FOR PRINTING PRESS FEEDER

[76] Inventor: Harold E. Paulson, 360 Wynland Trace, Dunwoody, Ga. 30350

[21] Appl. No.: 661,235

[22] Filed: Feb. 25, 1991

[51] Int. Cl.[5] ..... B65H 3/08

[52] U.S. Cl. ..... 271/99; 271/2; 271/90; 271/108; 271/276

[58] Field of Search ..... 271/11, 14, 90, 95, 271/96, 99, 100, 107, 108, 112, 165, 276, 2

[56] References Cited

U.S. PATENT DOCUMENTS

| | | | |
|---|---|---|---|
| 3,851,871 | 12/1974 | Aronson | 271/99 X |
| 4,121,819 | 10/1978 | DiFrancesco et al. | 271/96 |
| 4,202,542 | 5/1980 | Lammers et al. | 271/96 X |
| 4,583,729 | 4/1986 | Blumle | 271/108 X |
| 4,986,522 | 1/1991 | Paulson | 271/2 |

FOREIGN PATENT DOCUMENTS

| | | | |
|---|---|---|---|
| 3808651 | 10/1989 | Fed. Rep. of Germany | 271/100 |
| 23197 | 3/1981 | Japan | 271/96 |

*Primary Examiner*—Joseph E. Valenza
*Assistant Examiner*—Boris Milef
*Attorney, Agent, or Firm*—Jacobson and Johnson

[57] ABSTRACT

A vacuum drum is located in close proximity to the lowermost flat workpiece in a stack of workpieces in a hopper for applying a suction to remove the bottom-most workpieces one at a time from the hopper for passing on to a conveyor to a printing press. The drum is mounted on a reciprocably rotatable hollow-cored shaft for reciprocable rotation therewith and has multiple sets of vacuum outlets which can be selectively positioned in vacuum communication with the hollow bore of the shaft for feeding vacuum from the shaft bore to a selected one of the multiple sets of vacuum outlets so that the drum can be used for a variety of workpieces.

7 Claims, 4 Drawing Sheets

VACUUM DRUM FOR PRINTING PRESS FEEDER

FIELD OF THE INVENTION

This invention is directed generally toward a printing press feeder which utilizes a reciprocably rotating vacuum drum for removing individual flat workpieces from a stack of workpieces resting in a hopper and feeding the workpieces one at a time in tandem to a conveyor for delivery to a printing press. More specifically, the invention is directed toward a vacuum drum having multiple sets of vacuum outlets which can be adjustably positioned to apply suction to the lowermost workpiece in the stack so that the same drum can be used for a variety of workpieces.

DESCRIPTION OF THE PRIOR ART

My co-pending U.S. patent application Ser. No. 413,435 filed Sept. 27, 1989, titled "PRINTING PRESS FEED MECHANISM" describes a printing press feeder used for feeding stacked windowed envelopes from a hopper to a conveyor for transporting the envelopes one at a time to the printing press. The feeder utilizes a reciprocably rotating feeder roller which includes a vacuum drum mounted on a reciprocably rotating shaft for applying vacuum to the underside of the bottommost envelope in the hopper to pull it out of the hopper and advance it towards a conveyor for transportation to a printing press. The vacuum is fed into one end of the hollow bore of the shaft and then radially outward through a suitable vacuum passageway into a vacuum chamber in the drum and is applied to the envelope through vacuum outlet openings in vacuum communication with the drum vacuum chamber. The arrangment, as described in my aforementioned '435 application, is designed specifically for windowed envelopes to minimize the possibility of an edge of the window on the lowermost envelope in the stack from catching the edge of the flap of the envelope stacked just above it as the lowermost envelope is removed from the stack. To use the feeder for other workpieces, e.g., envelopes without windows or lightweight sheets of different sizes, it was necessary to remove the vacuum drum and replace it with another drum which was also specifically designed for use with the new workpiece. Correspondingly, the hopper usually had to be adjusted so that the stack of workpieces is in proper position relative to the vacuum drum.

SUMMARY OF THE INVENTION

The instant invention basically functions in the same fashion as the device described in my aforementioned '435 patent application, i.e., a vacuum drum is mounted on a reciprocably rotatable hollow shaft so that it is in close proximity to the leading edge of the lowermost workpiece in a stack of flat workpieces in a hopper and the drum receives vacuum from the hollow bore of the shaft and applies it to the workpiece through vacuum outlet ports. As the shaft and drum rotate in a first direction from a starting position the suction applied to the lowermost envelope in the stack pulls it down and advances it toward a set of pinch rollers which then direct it to a conveyor for transporting it to a printing station. When the shaft and drum reach a second position they rotate back in a reverse direction to the starting position to get ready to remove and advance the next workpiece at the bottom of the hopper. The present invention comprises a drum with multiple separate sets of vacuum outlet ports for applying the suction to the lowermost workpiece in the hopper stack and each of said sets of outlet ports can be selectively positioned to be in vacuum communication with the hollow bore of the shaft. This is done by unloosening the coupling between the shaft and the drum and rotating the drum on the shaft until the drum vacuum passageway to the selected set of outlet ports is in vacuum communication with the bore of the shaft and then retightening the coupling between the drum and the shaft. Each of the sets of outlet ports is designed to be most effectively used with a different type of workpiece. So when the workpiece in the feeder hopper is changed, the user merely selects the set of drum vacuum outlet ports which are appropriate for the type of workpiece and adjusts the drum on the shaft so that the selected outlet ports will be in place to apply the vacuum to the workpieces in the hopper. Generally, when the type of workpiece is changed, which then requires the drum vacuum outlet ports to be changed, correspondingly the location of the hopper usually must also be adjusted so that the stack of workpieces is properly positioned with respect to the vacuum drum outlet ports. This is made somewhat convenient by pivotally mounting the hopper stand with respect to the shaft and drum so that the stand can be unlocked, then swung up or down as needed to place the stack of workpieces at the appropriate location, and then secured in place.

In this fashion, then, the printing press feeder is more versatile and requires a minimal amount of adjustment to adapt the feeder to a variety of different workpieces.

DESCRIPTION OF THE PREFERRED EMBODIMENTS

Figure 1:
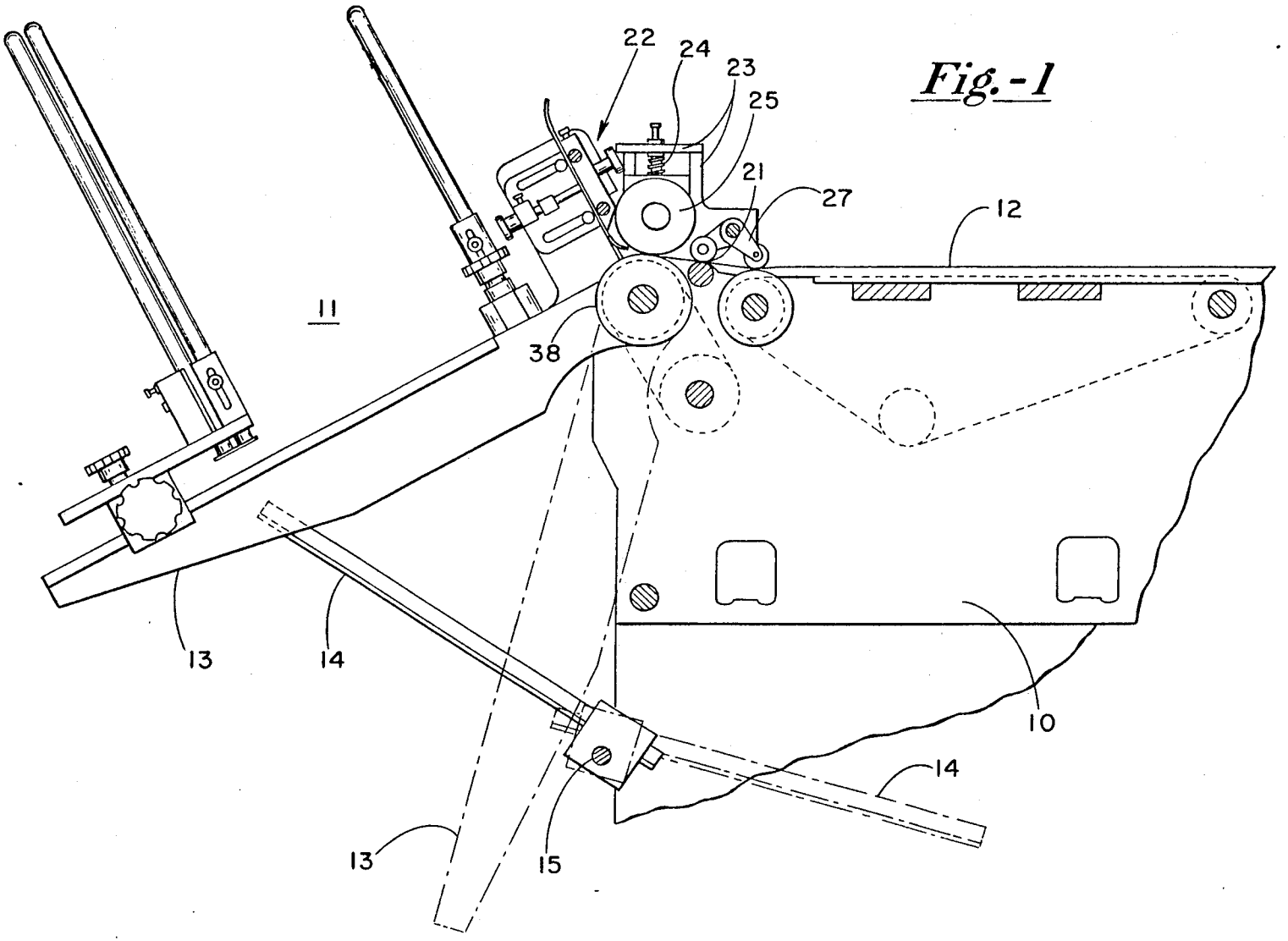
FIG. 1 is a side plan view generally functionally illustrating a printing press feeder utilizing an embodiment of the invention.

My aforementioned co-pending U.S. patent application Ser. No. 413,435 titled "PRINTING PRESS FEED MECHANISM" describes in detail the functional operation of a printing press feeder which operates generally in the same fashion as the printing press feeder with which the instant invention is used and for that purpose is incorporated herein by reference. As described in greater detail in the '435 application, a main support structure or frame, generally designated by reference numeral 10, supports a series of shafts having pulleys or sprockets or the like mounted thereon, a few of which are shown in FIG. 1, to provide the driving mechanisms to remove flat workpieces 18 (FIG. 3) one at a time from a stack in a hopper 11 and carry them one at a time in tandem on a conveyor, such as endless belt or chain 12, downstream to a printing press, not shown. The hopper 11 is fairly conventional and is attached to a tiltable feed table 13 which is pivotably attached at one end to the frame 10 about an axis corresponding to the rotational axis of the feeder roller (which will be identified and described later) so that the feed table can be swung in an arc of about ninety degrees ranging from a general vertical orientation to a virtually horizontal position to place the stack of workpieces in the hopper in suitable orientation with respect to the feeder roller as determined by the nature and the characteristics of the workpieces. An arm 14 attached at one end to feeder table 13 can be loosened and tightened by knob 15 to allow the feed table to be swung to the appropriate orientation and then locked in place. While the '435 application shows a double-hopper feeder, the instant invention will be described only with reference to a single hopper.

Figure 2:
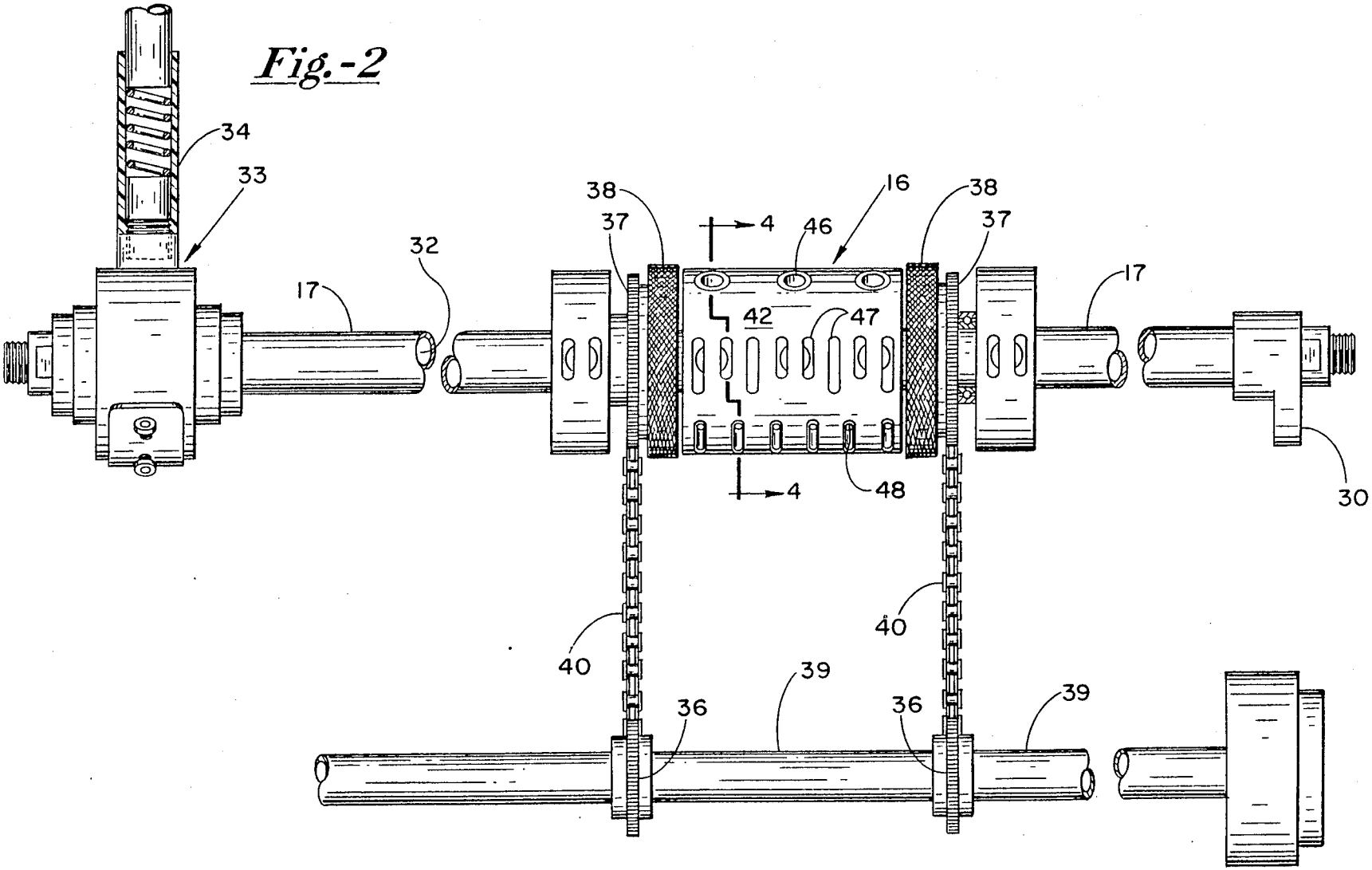
FIG. 2 illustrates in greater detail a vacuum drum constituting an embodiment of the invention functionally mounted in a printing press feeder.
Figure 3:
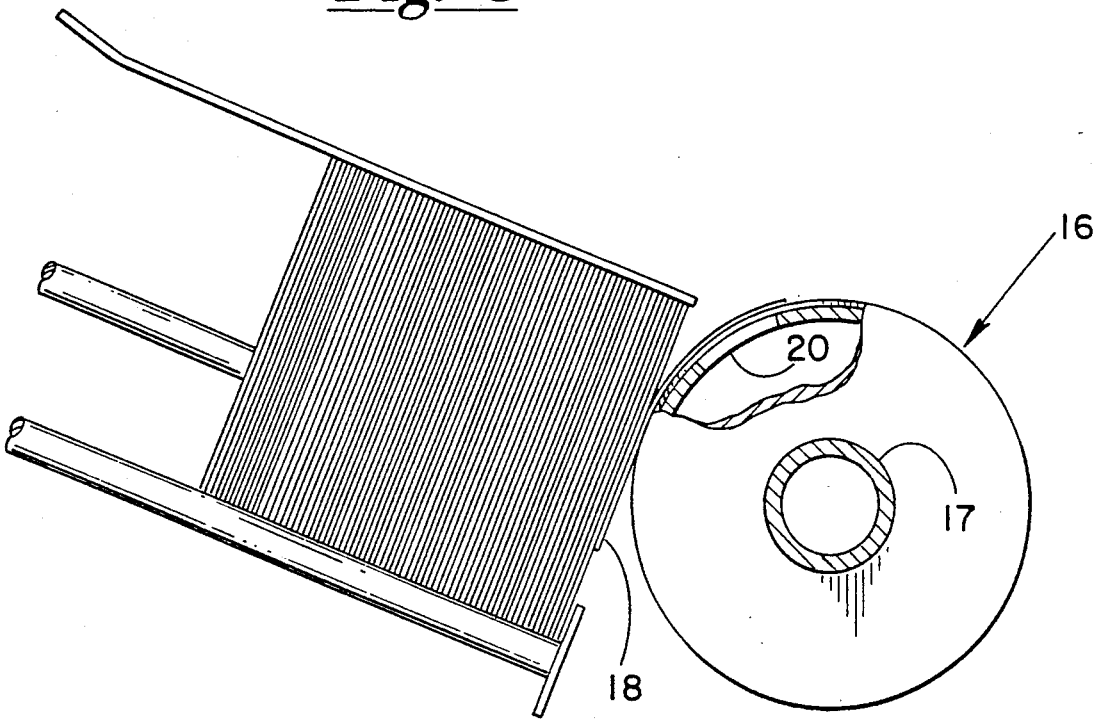
FIG. 3 is a side view functionally illustrating the operation of the vacuum drum.

As functionally illustrated in FIG. 3, a vacuum drum 16 mounted on a reciprocably rotatable shaft 17 is located in close proximity to the lowermost flat workpiece 18 in a stack of workpieces resting in hopper 11. When the drum 16 rotates in a clockwise direction, as observed in FIGS. 1 and 3, suction applied through a vacuum outlet opening 20 on drum 16 pulls down the leading edge of the lowermost workpiece 18 and carries it clockwise to a pair of pinch rollers 21, FIG. 3, which then direct it to conveyor 12. When the pinch rollers take over, drum 16 is rotated counterclockwise back to its starting point and then it repeats this action over and over again until all of the workpieces are removed from the stack. In the '435 patent application the vacuum-applying mechanism which includes the vacuum drum outlet openings and feeding of the vacuum through a hollow-cored reciprocably rotating shaft to the drum, was for the specific purpose of feeding windowed envelopes to a printer to avoid a hangup between an edge of the envelope flap and an edge of the window of the next adjacent envelope. The present invention is directed to be useful with a variety of flat workpieces which may include windowed or unwindowed envelopes of various sizes and weights, individual lightweight sheets of paper, such as letterheads, or heavier pamphlets or booklets, etc. so that it should be understood that the term workpiece is intended to be fairly generic covering a range of flat articles even though the drawings may illustrate the workpieces only as single sheets of paper. As illustrated in FIG. 1, the feeder also includes an adjustable head stop 22 which is used to guide the leading edge of the workpiece as it is pulled from the hopper to make sure that it travels in the right direction as it leaves the hopper. The feeder may also include air jets (not shown) which are suitably attached and directed to help ensure that very lightweight workpieces separate from one another as the lowermost workpiece is pulled out of the hopper. Also shown in FIG. 1 is a bracket 23 with a spring member 24 used to apply a downward force on a pair of upper feeder wheels 25 so that they stay in tangential friction contact with lower feeder rollers 38, described in greater detail with respect to FIG. 2, to grasp the leading edge of the removed workpiece and feed it on to pinch rollers 21 for deposit on conveyor 12. Also shown is a roller lever arm 27 which serves also to guide the workpiece onto the conveyor and also serves as a sensor to determine if more than one workpiece is being sent to the conveyor at one time and if so, to trigger an alarm and/or to turn off the machine.

Referring to FIG. 2, similar to the device illustrated and described in the '435 application, a lever arm 30 mounted on shaft 17 is attached to a bell crank arm, not shown, for reciprocably rotating shaft 17 about its longitudinal axis. Shaft 17 has a hollow bore 32 which is closed off at each end but at an end opposite the lever arm end is radially in vacuum communication with a vacuum source, not shown, through a vacuum coupling generally designated by reference numeral 33. The details of the operation of the mechanism for feeding the vacuum into the bore 32 of shaft 17 is contained in the '435 application and for that purpose the latter is incorporated herein by reference. In general, as shaft 17 reciprocably rotates, a vacuum inlet opening to bore 32 of shaft 17 for establishing vacuum communication with vacuum conduit 34 moves from a fully opened to a substantially fully closed position correspondingly to feed maximum and minimum vacuum to bore 32 of shaft 17. As an aside, it should be mentioned that in some cases it has been found that some amount of vacuum should always be present at the input to bore 32 and this can be easily arranged.

Mounted on shaft 17 is vacuum drum 16 which is a cylinder whose longitudinal axis is coaxial with shaft 17 and which is mounted to reciprocably rotate along with shaft 17. Coaxially mounted on shaft 17 are sprockets 37 which are attached to knurled feeder wheels 38 on each side of vacuum drum 16. Feeder wheels 38 and sprockets 37 are suitably mounted on bearings, not shown, on shaft 17 so they are free to rotate with respect to shaft 17 and vacuum drum 16. A pair of sprockets or pulleys 36 are coaxially mounted on a shaft 39 which is parallel to shaft 17 and are coupled via belts or chains 40 to sprockets 37 to be continuously driven in one direction, generally clockwise as observed in FIG. 1, to assist in delivering the workpieces from the hopper to the conveyor 12. As mentioned earlier, in its initial or starting position, suitable vacuum outlet openings on drum 16 apply suction to the lowermost workpiece 18 stacked in the hopper and as the drum rotates clockwise (per FIG. 1) to advance the workpiece toward the conveyor the knurled feeder wheels 38 also assist in advancing the workpieces toward the conveyor as they continuously rotate in a clockwise direction. A pair of knurled upper feeder wheels 25 (FIG. 1) are not separately driven but are rotated about their mounting shaft counterclockwise, as observed in FIG. 1, by frictional, tangential contact with feeder wheels 38. The workpieces pass between the two sets of feeder wheels 25 and 38 and then between pinch rollers 21 so that when drum 16 is rotated counterclockwise back to its original or starting position to pick up another workpiece, the previous workpiece is advanced to and placed on conveyor 12.

Figure 4:
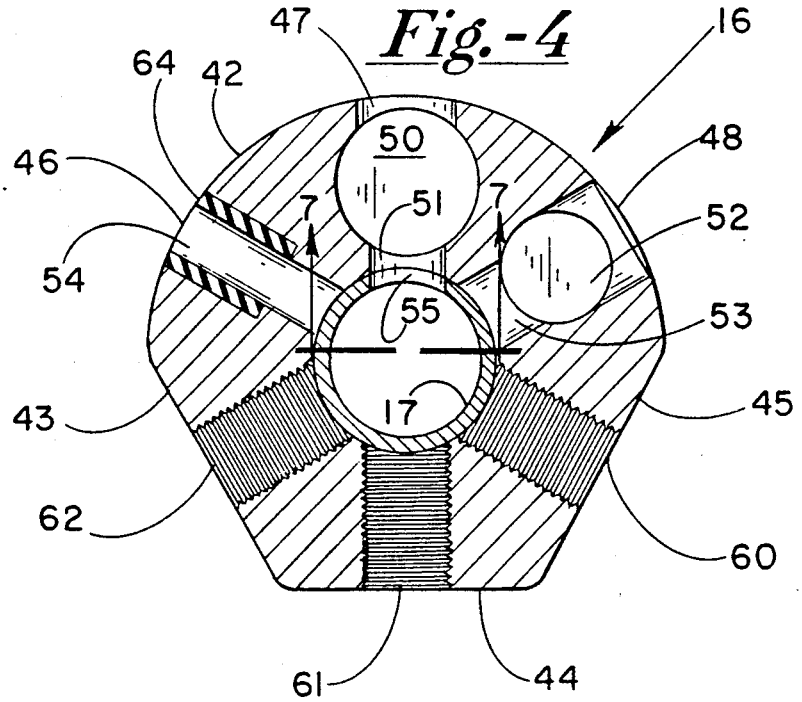
FIG. 4 is a section view of the vacuum drum in FIG. 2 taken along viewing line 4—4.
Figure 5:
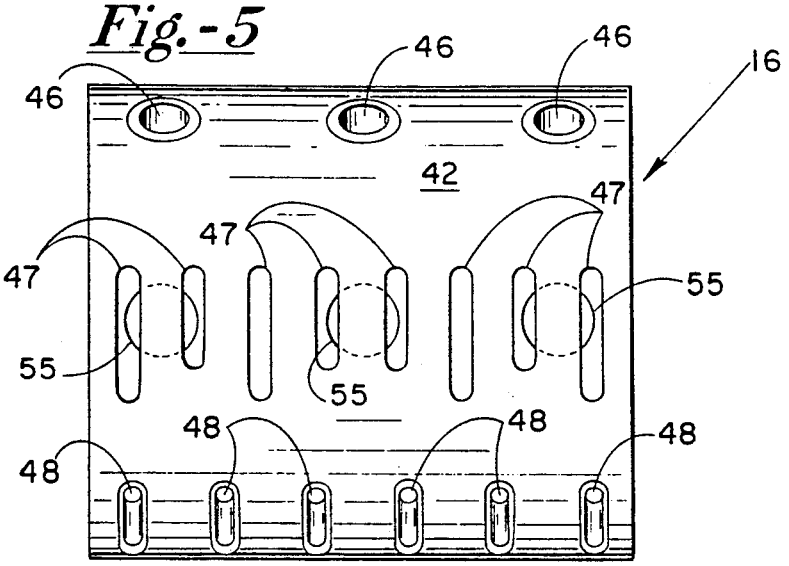
FIG. 5 is a somewhat enlarged view of the outside of the vacuum drum showing the vacuum outlet ports.
Figure 6:
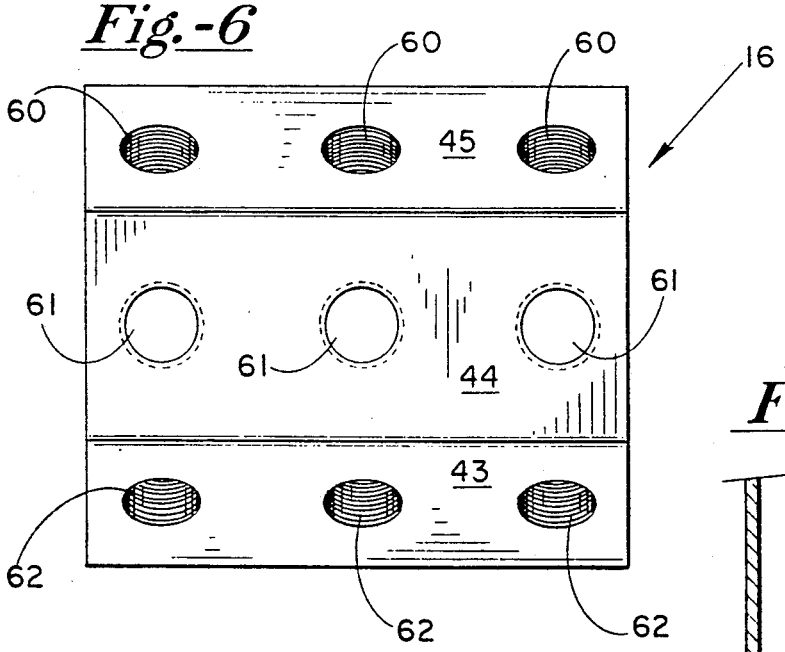
FIG. 6 is a somewhat enlarged view of the outside of the vacuum drum showing the mounting holes.
Figure 7:
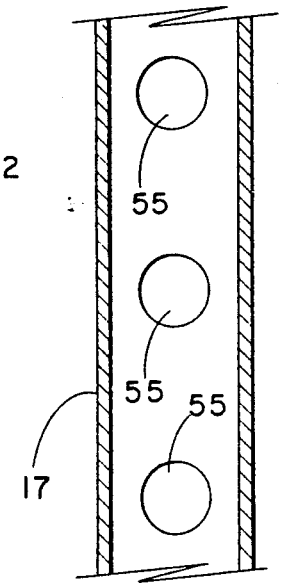
FIG. 7 is a sectioned view of the reciprocable shaft illustrating the vacuum opening to the drum.

The general configuration of vacuum drum 16 is cylindrical but in actuality about one-half of the periphery, designated by reference numeral 42, is circular and the other half has three adjacent flats, 43 and 44 and 45. Drum 16 has a hollow core for receiving the hollow-cored shaft 17 on which it is mounted. A preferred embodiment of drum 16 has three separate sets of vacuum outlet ports in the circular area 42. One set comprises three spaced-apart circular openings designated by reference numeral 46, a second set comprises a series of spaced-apart elongated slots 47 and the third set comprises a group of beveled, equal-length spaced-apart slots 48. As illustrated in FIG. 4, vacuum outlet openings 47 can be placed in vacuum communication with the hollow bore of the drum through a chamber 50 and a radial opening 51; vacuum outlet openings 48 can be placed in vacuum communication with the bore of the drum through a chamber 52 and a radial opening 53; and vacuum outlet openings 46 each can be placed in vacuum communication with the bore of drum 16 by cylindrical, radially-extending passageways 54. In fact from the hollow bore of drum 16 there are three radial openings 51 to vacuum chamber 50 and three radial openings 53 to chamber 52. Correspondingly, hollow shaft 17 has three circular radially extending openings 55 (FIG. 7) from its bore for selectively establishing vacuum communication with one of the sets of vacuum outlet ports on drum 16.

As illustrated in FIG. 4, diametrically opposite the set of vacuum outlet ports 46 is a set of three internally-threaded radially-extending openings 60; diametrically opposite vacuum outlet openings 47 is a set of internally-threaded radially-extending openings 61; and diametrically opposite vacuum outlet ports 48 is a set of three internally-threaded radially-extending openings 62. Threadably engaged in each of the threaded openings 60, 61 and 62 is a set screw, not shown, for releasably securing drum 16 onto shaft 17. Depending upon the type of workpiece with which the drum is to be used, the selected set of vacuum outlet openings 46, 47 or 48 can be brought into vacuum communication with the vacuum carried in the hollow bore of shaft 17 through openings 55 by unloosening the set screws and rotating the drum on the shaft until openings 55 come in line with openings 51, for outlets 47, or in line with openings 53, for outlets 48, or in line with radial openings 54, for vacuum outlets 46. When the selection has been made the set screws are tightened to secure the drum in place on the shaft.

Experience and some testing has found that in general heavier workpieces, such as booklets, need the three circular vacuum outlets 46 without a common chamber in the drum for reliably feeding the workpieces out of the hopper and that the elongated slot openings 47 with variations in length are needed for envelopes, and the equal length slot openings 48 with beveled edges are needed for very lightweight sheets of paper. In addition, it has been found that a rubber-like insert 64 should be placed in each opening 54 to assist in moving the heavier items, such as booklets, out of the hopper. It is also preferable that means should be provided to adjustably move inserts 64 radially outward since the inserts become worn with use.

As mentioned earlier, in general it is necessary to adjust the angular disposition of the hopper along with the vacuum drum adjustment for each of the different types of workpieces. It may also be necessary to make some adjustment of the relation of shaft 17 with respect to the vacuum feed mechanism 33 in order to obtain most efficient operation of the feeder mechanism for a given type of workpiece.

It should also be recognized that other types of vacuum outlet configurations may be provided for a given type of workpiece. For example, with some workpieces a combination of elongated slots and circular openings might provide better and more efficient operation of the feeder. Also, it is possible that in some instances some additional mechanisms might be necessary in order to supplement or assist the vacuum drum in removing the workpieces one at a time in a satisfactory manner. For example, as mentioned in the co-pending '435 application, it may be necessary to provide a finger or the like to assist in removing heavier workpieces one at a time from the bottom of the hopper. In addition, in the case of workpieces significantly wider than the drum, it might be necessary to provide some additional vacuum beyond the ends of the drum to apply a vacuum to the outer edges of the workpiece to make sure that the outer edges are held onto the roller until the pinch rollers are able to grasp the workpiece and feed it to the conveyor. Further, as mentioned earlier, in the case of very light workpieces such as light sheets of paper, it may be necessary to provide some assistance, for example in the form of a flow of lightly pressurized air, to separate the bottommost sheet from the others in the hopper.

I claim:

1. A vacuum applying device for a printing press feeder for applying suction to the lowermost workpiece of a stack of flat workpieces in a hopper for removing the workpieces one at a time from the hopper for feeding to a printing press, said printing press feeder having a reciprocably rotating shaft having a hollow bore for carrying a vacuum, said vacuum applying device comprising:

a cylindrical drum having an axial bore for mounting the drum coaxially to the reciprocably rotating shaft of the printing press feeder for reciprocable rotation therewith;

said drum having a plurality of separate sets of radially extending vacuum outlet ports angularly disposed about the axis of said drum; and means for selectively providing vacuum communication from the hollow bore of said shaft separately to each set of vacuum outlet ports on said drum to the exclusion of the other sets.

2. The vacuum applying device as described in claim 1 wherein said latter means comprises:

angularly disposed separate vacuum passageways in said drum for each of said sets of vacuum outlet ports extending radially outward from the drum bore to a corresponding one of said sets of vacuum outlet ports;

a radially extending vacuum passageway from the hollow bore of said feeder shaft; and means for angularly positioning said drum on said shaft for placing said vacuum passageway on said shaft in vacuum communication with only a selected one of the vacuum passageways in said drum.

3. The vacuum applying device as described in claim 1 wherein at least one set of said drum vacuum outlet ports comprises a series of elongated parallel slots extending lengthwise in the direction of rotation of the drum, said slots spaced from one another along the drum axis.

4. The vacuum applying device as described in claim 3 in which the edges of said slots are beveled.

5. The vacuum applying device as described in claim 1 wherein at least one set of drum vacuum outlet ports comprises a series of spaced apart circular apertures.

6. The vacuum applying device as described in claim 5 further including a hollow-cored tubular member nested in each of said circular apertures with an end of said member in close proximity to the outer surface of said drum for contacting the lowermost workpiece for aiding removal of said workpiece from the hopper.

7. For use in a printing press feeder having a hopper containing a stack of flat workpieces to be fed singly to a printing press, a vacuum applying device for repetitively removing the bottom workpiece from the hopper for feeding it to a conveyor, said device comprising:

an elongated shaft having a hollow bore;

means for feeding a vacuum into the shaft bore in close proximity to one end;

vacuum outlet means extending radially outward from the shaft hollow bore;

means for reciprocably rotating said shaft about its longitudinal axis;

a generally cylindrical vacuum drum coaxially mounted on said shaft for reciprocable rotation therewith in close proximity to the bottom workpiece in the hopper;

multiple separate sets of radially extending vacuum outlet ports on said drum for applying vacuum to the bottom workpiece in the hopper for withdrawing workpieces one at a time from the bottom of the hopper as the drum reciprocably rotates;

separate radially extending vacuum passageways in said drum for each of said sets of outlet ports on said drum;

means for positioning a selected one of said drum vacuum passageways in vacuum communication with said shaft vacuum outlet means for feeding vacuum to a selected set of drum vacuum outlet ports;

said sets of vacuum drum outlet ports configured for use with different types of workpieces.

* * * * *